US007479172B2

(12) United States Patent
Ivarsson

(10) Patent No.: US 7,479,172 B2
(45) Date of Patent: Jan. 20, 2009

(54) CYCLONIC SEPARATORS FOR SUCTION CLEANERS

(75) Inventor: Bengt Ivar Anders Ivarsson, Ma Wan (HK)

(73) Assignee: Vax Limited, Worcestershire (GB)

( * ) Notice: Subject to any disclaimer, the term of this patent is extended or adjusted under 35 U.S.C. 154(b) by 579 days.

(21) Appl. No.: 10/537,537

(22) PCT Filed: Dec. 2, 2003

(86) PCT No.: PCT/GB03/05193

§ 371 (c)(1),
(2), (4) Date: Nov. 4, 2005

(87) PCT Pub. No.: WO2004/049890

PCT Pub. Date: Jun. 17, 2004

(65) Prior Publication Data

US 2006/0150588 A1 Jul. 13, 2006

(30) Foreign Application Priority Data

Dec. 3, 2002 (GB) ..... 0228152.5

(51) Int. Cl.
*B01D 45/12* (2006.01)

(52) U.S. Cl. ..... 55/345; 55/429; 55/DIG. 3; 15/350; 15/353

(58) Field of Classification Search ..... 55/345, 55/429, 459.1, DIG. 3; 15/350, 353
See application file for complete search history.

(56) References Cited

U.S. PATENT DOCUMENTS 5,078,761 A 1/1992 Dyson
5,125,127 A 6/1992 Bach et al.
5,135,552 A 8/1992 Weistra
5,351,362 A 10/1994 Kramer et al.
5,500,979 A 3/1996 Wörwag
5,893,936 A * 4/1999 Dyson ..... 55/337
5,960,514 A 10/1999 Miller et al.
6,058,559 A 5/2000 Yoshimi et al.

(Continued)

FOREIGN PATENT DOCUMENTS

DE 3834686 C1 12/1989

(Continued)

OTHER PUBLICATIONS

European Search Report for Application No. 03 778 550.8, dated Jul. 25, 2006, 3 pgs.

(Continued)

*Primary Examiner*—Tony G Soohoo
*Assistant Examiner*—Dung Bui
(74) *Attorney, Agent, or Firm*—Michael Best & Friedrich LLP

(57) ABSTRACT

A dust separating apparatus for a suction cleaner comprises a cyclonic separating device (10) having a body (12) with an inlet and an outlet for a stream of air and an outlet for separated dust to enter a receptacle (34) for the dust, the body having a part (14) movable in relation to the rest (13) of the body while the rest of the body remains in position in the cleaner, to give access to the interior of the body for cleaning. There may be two separating devices (10, 11) arranged in succession, both having removable body parts (14, 24).

8 Claims, 8 Drawing Sheets

U.S. PATENT DOCUMENTS

| | | | | |
|---|---|---|---|---|
| 6,108,865 | A | 8/2000 | Veser et al. | |
| 6,350,292 | B1 | 2/2002 | Lee et al. | |
| 6,398,834 | B2 | 6/2002 | Oh | |
| 6,562,093 | B2 | 5/2003 | Oh | |
| 6,572,668 | B1 | 6/2003 | An et al. | |
| 6,662,403 | B2 | 12/2003 | Oh | |
| 6,810,558 | B2 | 11/2004 | Lee | |
| 2002/0011053 | A1 | 1/2002 | Oh | |
| 2002/0062632 | A1 | 5/2002 | Oh | |
| 2002/0088078 | A1 | 7/2002 | Oh et al. | |
| 2002/0120998 | A1 | 9/2002 | Dubos et al. | |
| 2002/0124538 | A1 | 9/2002 | Oh et al. | |
| 2003/0106182 | A1 | 6/2003 | Lee | |
| 2003/0106183 | A1 | 6/2003 | Frederick et al. | |
| 2008/0086836 | A1 * | 4/2008 | Carr et al. | 15/353 |

FOREIGN PATENT DOCUMENTS

| | | | |
|---|---|---|---|
| DE | 9420797 | U1 | 7/1995 |
| DE | 299 00 460 | U1 | 8/2000 |
| DE | 199 14 574 | C1 | 11/2000 |
| DE | 10142016 | A1 | 6/2002 |
| DE | 10153898 | A1 | 8/2002 |
| DE | 101 10 771 | A1 | 9/2002 |
| EP | 489468 | A1 | 6/1992 |
| EP | 887040 | A1 | 12/1998 |
| EP | 1 386 573 | A2 | 2/2004 |
| FR | 2425227 | A1 | 12/1979 |
| GB | 2 128 075 | A | 4/1984 |
| GB | 2296452 | A | 7/1996 |
| GB | 2 367 510 | A | 4/2002 |
| GB | 2368516 | A * | 5/2002 |
| WO | WO 9835602 | A1 | 8/1998 |
| WO | WO 2004/049887 | A1 | 6/2004 |
| WO | WO 2004/049889 | A1 | 6/2004 |
| WO | WO 2004/052166 | A1 | 6/2004 |

OTHER PUBLICATIONS

Examination report for Australian application No. 2003285554, dated Dec. 21, 2006, 5 pages.
Examination report for Australian application No. 2003285552, dated Dec. 22, 2006, 4 pages.
Examination report for Indian application No. 2640/DELNP/2005, dated Jun. 12, 2007, 3 pages.
Examination report for Russian application No. 2005120765, dated Jun. 22, 2006, 3 pages.
Examination report for Russian application No. 2005120733, dated Jun. 22, 2006, 4 pages.
Pending U.S. Appl. No. 11/187,414, filed Jul. 22, 2005, 23 pages.
Pending U.S. Appl. No. 11/217,584, filed Aug. 31, 2005, 17 pages.
Pending U.S. Appl. No. 29/240,051, filed Oct. 7, 2005, 6 pages.
Pending U.S. Appl. No. 29/240,115, filed Oct. 7, 2005, 6 pages.
Pending U.S. Appl. No. 29/240,116, filed Oct. 7, 2005, 5 pages.
Pending U.S. Appl. No. 29/240,117, filed Oct. 7, 2005, 7 pages.
Pending U.S. Appl. No. 29/240,118, filed Oct. 7, 2005, 7 pages.
Pending U.S. Appl. No. 10/537,381, filed Nov. 14, 2005, 25 pages.
Pending U.S. Appl. No. 10/537,382, filed Nov. 14, 2005, 33 pages.
Pending U.S. Appl. No. 10/537,481, filed Nov. 14, 2005, 14 pages.
Pending U.S. Appl. No. 11/273,094, filed Nov. 14, 2005, 17 pages.
Pending U.S. Appl. No. 11/329,194, filed Jan. 10, 2006, 23 pages.
Pending U.S. Appl. No. 11/375,722, filed Mar. 15, 2006, 16 pages.

* cited by examiner

CYCLONIC SEPARATORS FOR SUCTION CLEANERS

DESCRIPTION OF THE INVENTION

This invention relates to cyclonic separators for suction cleaners.

Suction cleaners ("vacuum cleaners") are very well known products, in which dust (which expression as used herein includes other debris and embraces a range of particle sizes from microns to millimeters or even centimeters) is picked up by suction and entrained in an airflow, the dust particles subsequently being separated from the airflow in at least one cyclonic separator. The dust laden air is caused to pass through the separator(s), in which it flows at high speed in a circular path so that the dust particles are dumped out of the airflow by centrifugal force. The separator may include a filter or filters which remove all or very nearly all of any remaining entrained dust particles from the airflow, which will usually be particles of very small size.

In most suction cleaners using a cyclonic separator, the separated dust is retained in the vicinity of the separator, within a body of the separator at the bottom thereof having regard to its normal orientation in use. Disposal of this dust entails removal of all or part of the separator body from the cleaner, so that the dust can be emptied. Inherently this removal and the emptying procedure gives good access to the interior of the separator body which enables it to be cleaned if required. Cleaning of the inside of the separator body might be required if dust which is picked up by the cleaner is of a nature such that it sticks to any surface with which it makes contact and thus coats the inside of the separator body which eventually would detract from the effectiveness of operation of the separator: for example the picking up of damp dust such as plaster dust might have this effect. It also facilitates access to any filter, whether coarse or fine, within the separator body for any necessary cleaning or replacement of the filter.

It has been proposed that instead of collecting dust within the body of a separator the dust might be collected in a removable dust receptacle while the separator remains in position in the body of the cleaner. In this case the dust needs to pass from the separator by way of an outlet in the form of an aperture or opening in an appropriate position on a body of the separator, to enter the dust receptacle. Such an outlet by which dust leaves the separator body to enter the dust receptacle is unlikely to be sufficiently large to enable easy access to be gained by way of it for cleaning the separator body interior. It is also a possibility that if a large piece of debris is sucked up by the cleaner (assuming it is able to travel along the airflow passageways leading to the separator), it might not be able to pass through the outlet from the separator to the dust receptacle and thus be trapped in the separator body. Removal of such a piece of debris would be inconvenient and time consuming.

Accordingly it is an object of the present invention to overcome or reduce this disadvantage.

According to one aspect of the invention, we provide a dust separating apparatus for a suction cleaner, comprising a cyclonic separating device having a body with an inlet and an outlet for a stream of air and an outlet for dust separated from the airstream to enter a receptacle for the separated dust, wherein said body comprises a part movable in relation to the rest of the body while the rest of the body remains in position in the cleaner, to provide access to the interior thereof.

The movable part of the body may be completely removable therefrom, so that when the separating apparatus is installed in a suction cleaner the part can be removed from the cleaner leaving the rest of the body in position therein.

The separating device may have the inlet and outlet for the stream of air at one end of the body and the outlet for dust at the other end of the body, the removable part being that having the outlet for dust therein. The body may be of circular cross-sectional shape for the flow of the stream of air therein in a vortex between the air inlet and outlet, and may be of more or less constant cross-section or may taper, e.g. conically. With a tangential air inlet and a central air outlet at or towards one end of the body, the dust outlet may extend generally tangentially at or towards the other end of the body.

The separating apparatus may comprise first and second cyclonic separating devices each comprising a body with an inlet and an outlet for the stream of air and an outlet for separated dust. The two separating devices may be arranged successively with the air outlet of the first communicating with the air inlet of the second so that dust is separated from the airstream in two stages, the first separating device removing large dust particles from the stream of air and the second separating device removing any remaining particles after the first separating device, and also finer particles. At least the first separating device may have a movable body part as aforesaid and preferably both the separating devices are so provided.

The removable body part of the or each separating device may engage with the rest of the body thereof by a bayonet fitting, i.e. one requiring the removable part to be presented to the rest of the body in the direction of the longitudinal axis of the separator after which an angular movement thereof about the axis causes the engagement of at least one retaining formation to hold the parts together. Suitable sealing means such as a deformable gasket may be provided between the body parts to prevent air leakage at the connection therebetween.

According to another aspect of the invention, we provide a suction cleaner provided with a dust separating apparatus according to the first aspect of the invention as set forth in one or more of the preceding paragraphs.

The two separating devices may lie in a body or casing of the suction cleaner spaced from, e.g. in generally parallel disposition to, one another with a receptacle for separated dust having at least a part lying generally between them, the receptacle having respective inlets for separated dust communicating with the openings forming the dust outlets of the two separating devices.

The invention will now be described by way of example with reference to the accompanying drawings, of which:

Figure 1:
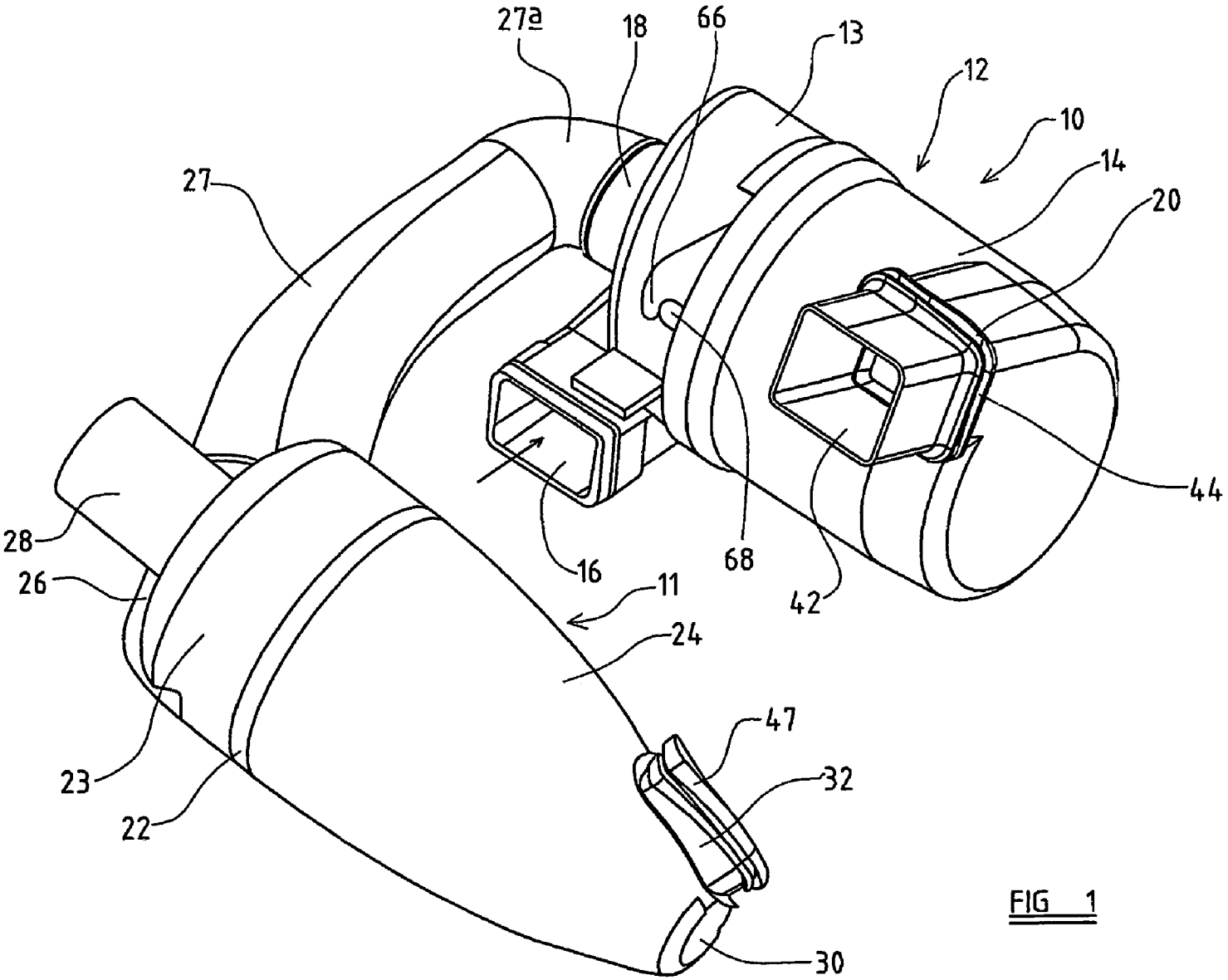
FIG. 1 is a diagrammatic perspective view showing an embodiment of dust separating apparatus in accordance with the invention.
Figure 2:
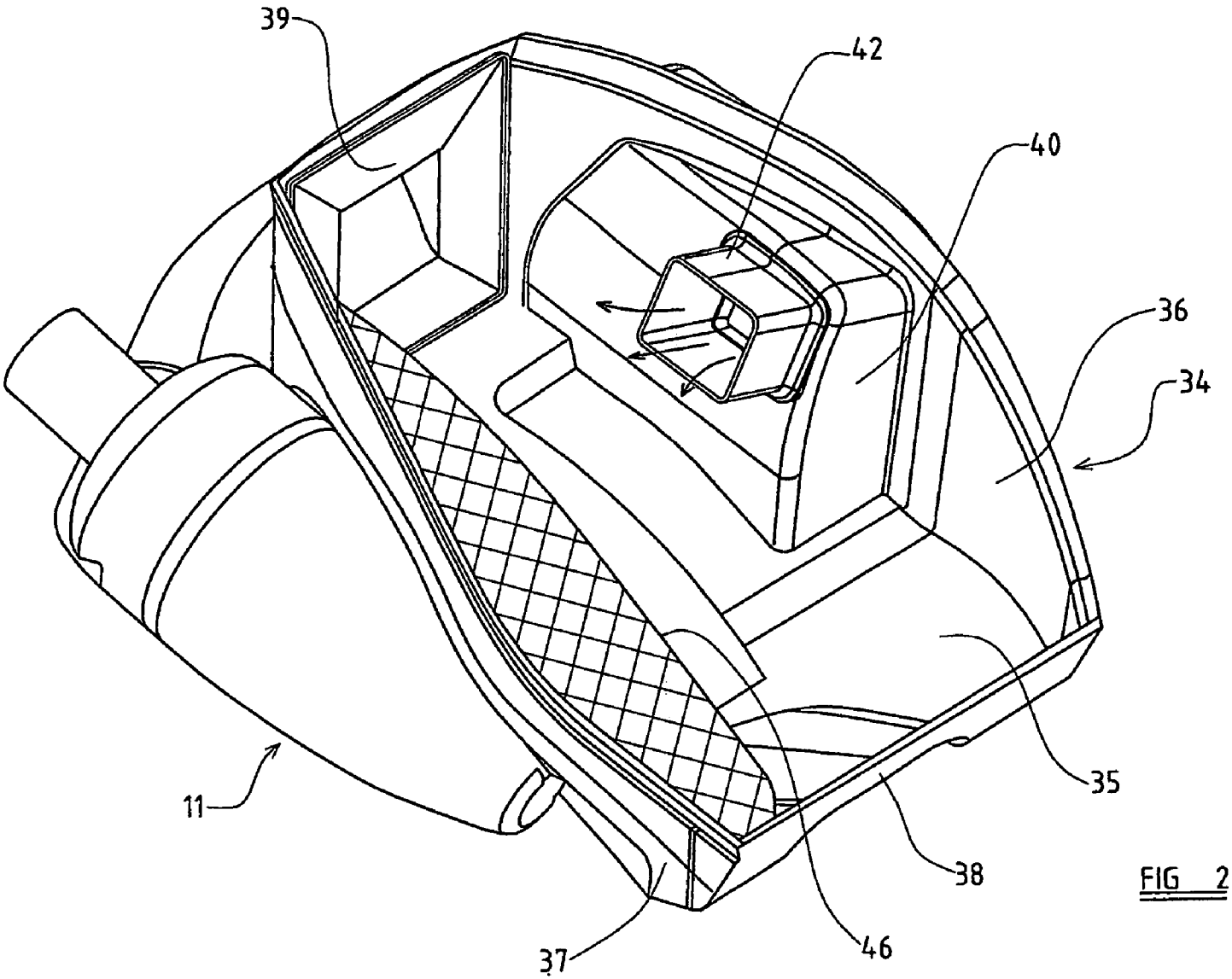
FIG. 2 is a perspective view as FIG. 1 showing the apparatus with a dust receptacle therebetween.
Figure 3:
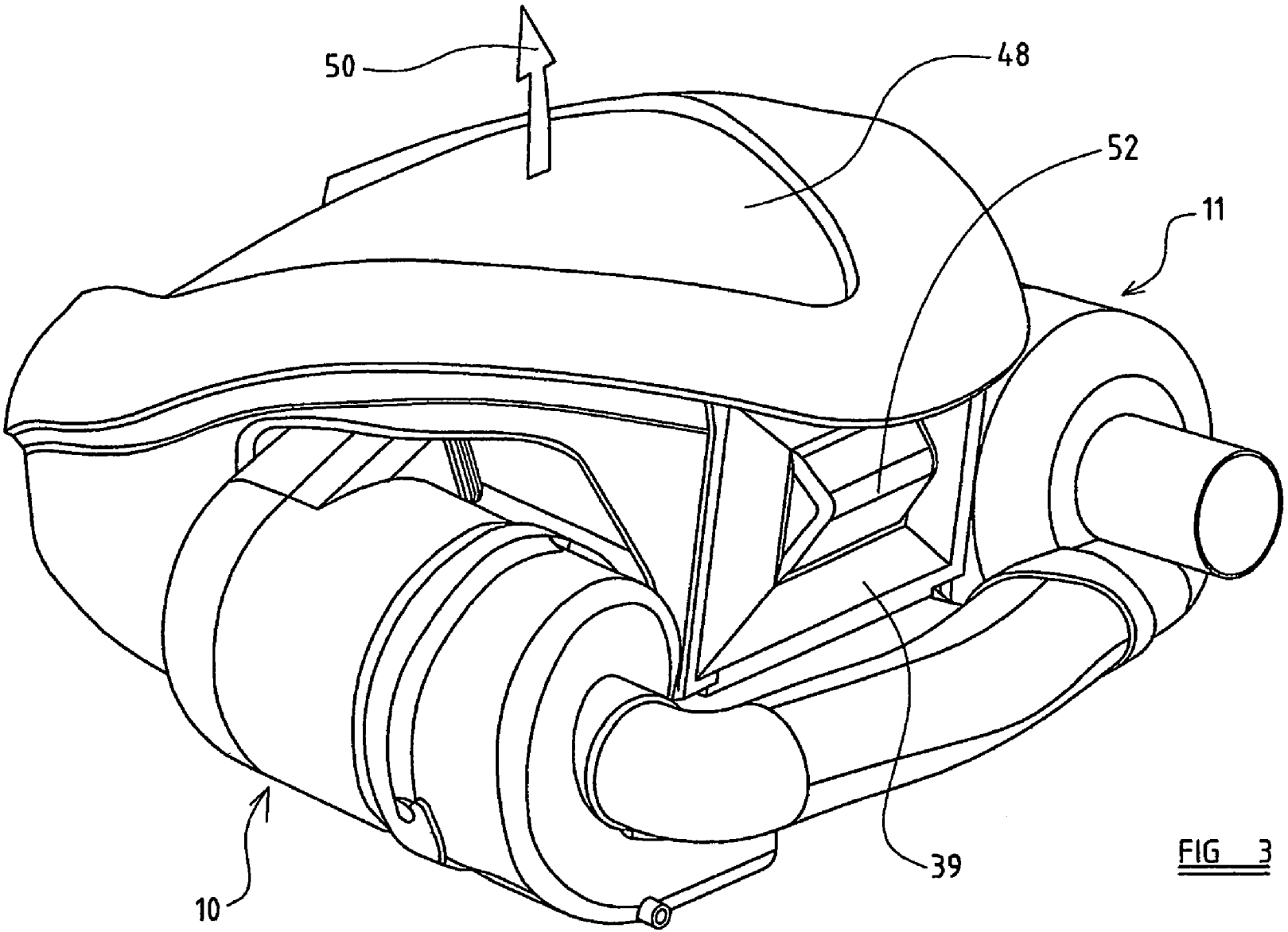
FIG. 3 is a view as FIG. 2 but from a different perspective viewpoint, illustrating the manner of removal of the dust receptacle.

Referring firstly to FIGS. 1 to 3 of the drawings, these show a dust separating apparatus in accordance with the invention, for use in a suction cleaner. FIGS. 2 and 3 show, in association with the separating apparatus, a receptacle for dust and other debris separated from the stream of air established by the cleaner when operating.

The separating apparatus comprises a first cyclonic separator indicated generally at 10 and a second cyclonic separator indicated generally at 11. Each of the separators is a cyclonic separating device, in which air flows in a stream from an air inlet to an air outlet and is caused to flow in a helical vortex within the separator, which causes entrained dust particles to be separated from the airstream by centrifugal force. Cyclonic separators in suction cleaners are well known. The axis about which such flow in a vortex takes place is called herein the axis of the separator, and terms such as axially, tangentially and so on make reference to such axis.

The first separator 10 comprises a body 12 with a first body part 13 and a second body part 14. The body 12 is generally cylindrical, of circular cross-sectional shape and more or less constant cross-sectional area along its length. The body part 13 has a tangentially oriented air inlet 16 for a stream of air with dust entrained therein. This will have been picked up at a cleaning head of the cleaner, connected thereto, e.g. by a flexible hose and rigid wand. The nature of the connection to the cleaning head is irrelevant to the present invention. The body part 13 further has a centrally disposed axially extending outlet 18 for the stream of air. The body part 14 has, at its end remote from the body part 13, a tangentially oriented lateral outlet opening 20 for dust separated from the stream of air by centrifugal force in the course of its flowing in a vortex between the inlet 16 and outlet 18 of the separator 10.

The second separator 11 is disposed with its axis generally parallel to the axis of separator 10, and comprises a body 22 with a first body part 23 and second body part 24. The body part 23 has a tangentially and slightly helically inclined inlet 26 for the stream of air which it receives from the outlet 18 of the first separator 10 by way of a connecting elbow 27*a* and duct 27. An outlet for the airstream extends axially through the centre of the body part 23 and is indicated at 28. This is arranged to be connected by suitable ducting to a suitable motor-driven fan in a suction cleaner, with a filter arranged in such connection to trap any dust particles not separated from the airstream by the separators 10, 11. The body part 24 of the separator 11 is of tapering configuration so that its end 30 remote from the body part 23 is of much smaller diameter than the latter. Adjacent its end 30 there is a lateral outlet opening 32 for dust separated from, the airstream by centrifugal force within the body 22 of the separator 11.

When installed in a suction cleaner a dust receptacle 34 is disposed generally in the region between the two separators 10, 11 for receiving dust separated from the airstream by the two separators. FIG. 2 shows that the dust receptacle 34 comprises a base 35, side walls 36, 37 and end walls 38, 39 defining an interior space for receiving dust from the separators and retaining it for disposal. Wall 36 has an inset part 40 (in which the separator 10 is partially accommodated) and in this inset part there is an inlet 42 for dust separated in the first separator 10 and discharged at the outlet opening 20 thereof, the inlet 42 to the dust receptacle, including a short tube 42 reaching into the interior volume of the receptacle 34: this helps ensure that the dust is retained in the receptacle. The inlet tube 42 is shown in FIG. 1 in its operative disposition registering with the outlet opening 20 of the separator 10: also visible is a flexible seal, e.g. of bellows type, 44, preventing leakage of air and dust between the separator 10 and dust receptacle 34 when the dust receptacle is in position.

On the opposite side of the receptacle 34 a partition wall 46 defines an internal compartment within the receptacle which is separated from the main internal volume thereof. This secondary compartment has an inlet opening which registers with the outlet 32 from the second separator 11 so that the secondary compartment can receive dust separated from the airstream by the second separator. A flexible seal operative between the separator 11 and the dust receptacle is shown in FIG. 1 at 47, around the end of the dust outlet 32 of the separator 11 and abutting the dust receptacle when the latter is in position, to prevent leakage of dust and air between the separator 11 and dust receptacle.

FIG. 3 is a perspective view from the opposite direction to that of FIGS. 1 and 2, showing the dust receptacle in position and also showing a cover 48 for the dust receptacle closing the top thereof which is shown open in FIG. 2. The cover 48 is intended, in a suction cleaner, to form part of the visible exterior casing of the suction cleaner, and hence is styled for compatibility with the rest of the suction cleaner casing. For disposal of dust collected in the dust receptacle, the receptacle as a whole is lifted away from the separators in the direction indicated by arrow 50 so that it can be taken to a suitable place for emptying and disposal. For such emptying, the end wall 39 of the receptacle may open pivotally from its normal position in which it is held by a latching device.

Also visible in FIG. 3 is a latching formation 52 on the end wall 39 of the dust receptacle, which forms part of the mechanism for retaining the dust receptacle in position in the cleaner.

Figure 4:
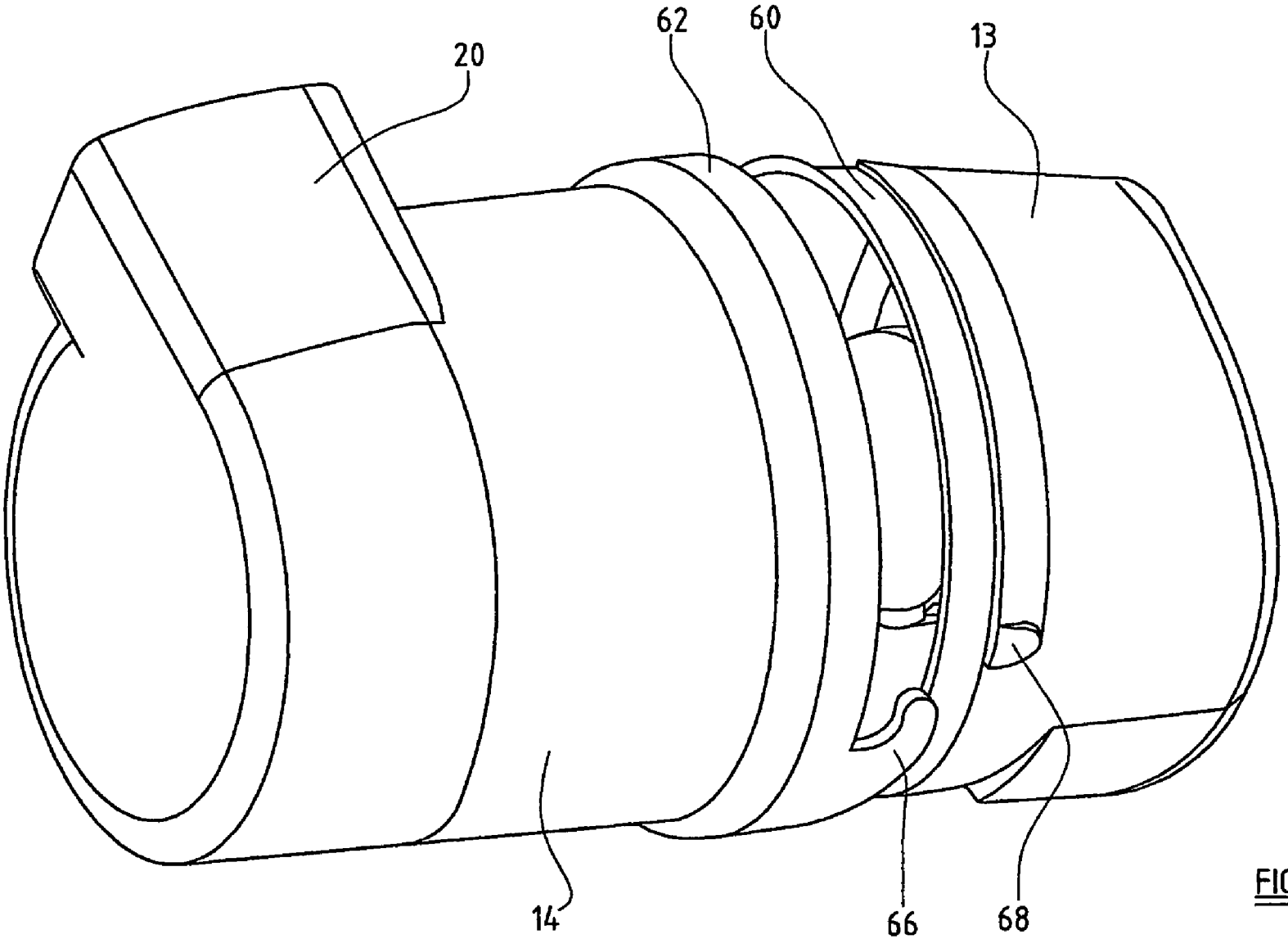
FIG. 4 is a perspective view of one of the separating devices, showing removal of a part of the body thereof.
Figure 5:
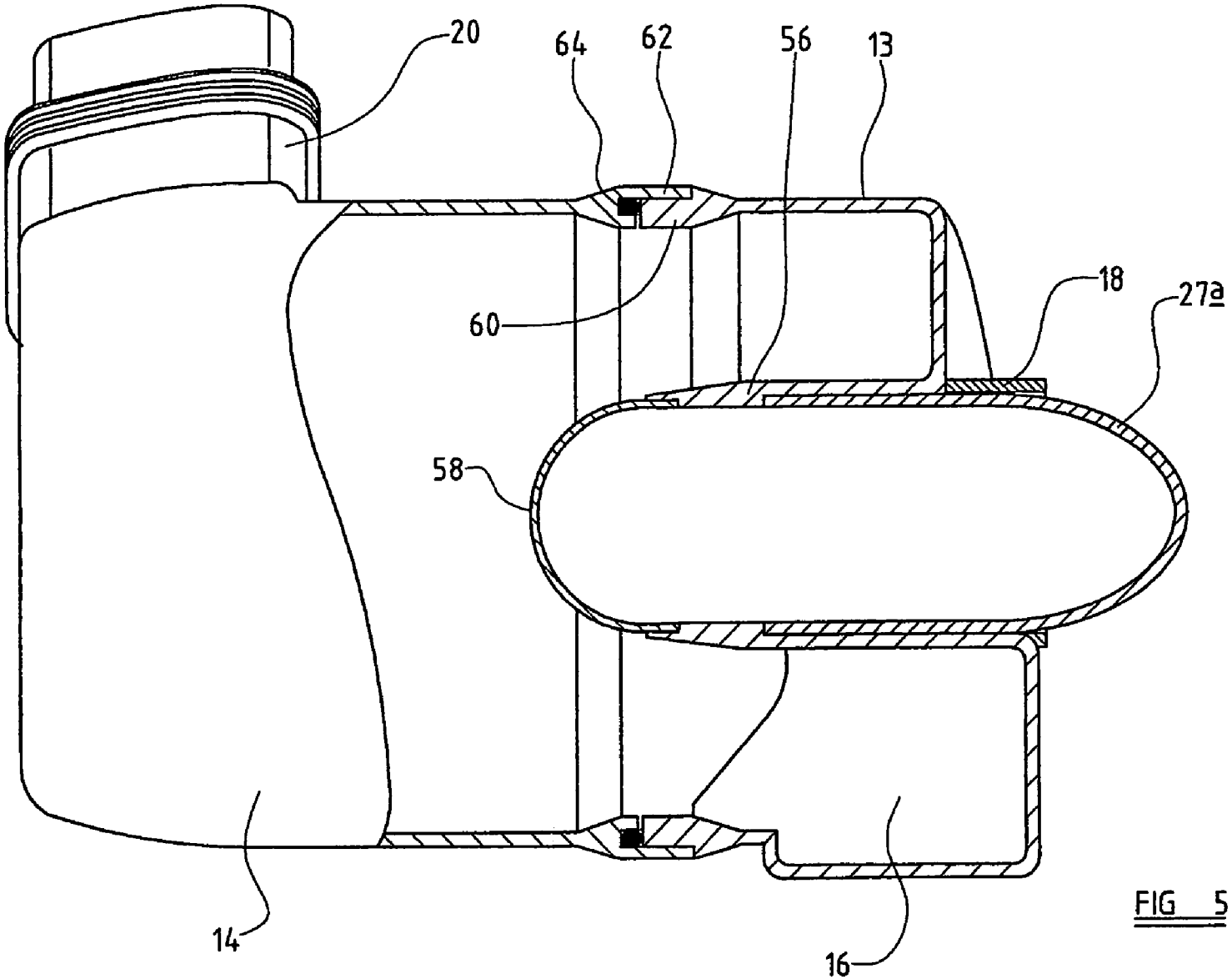
FIG. 5 is a section through the separating device of FIG. 4.
Figure 6:
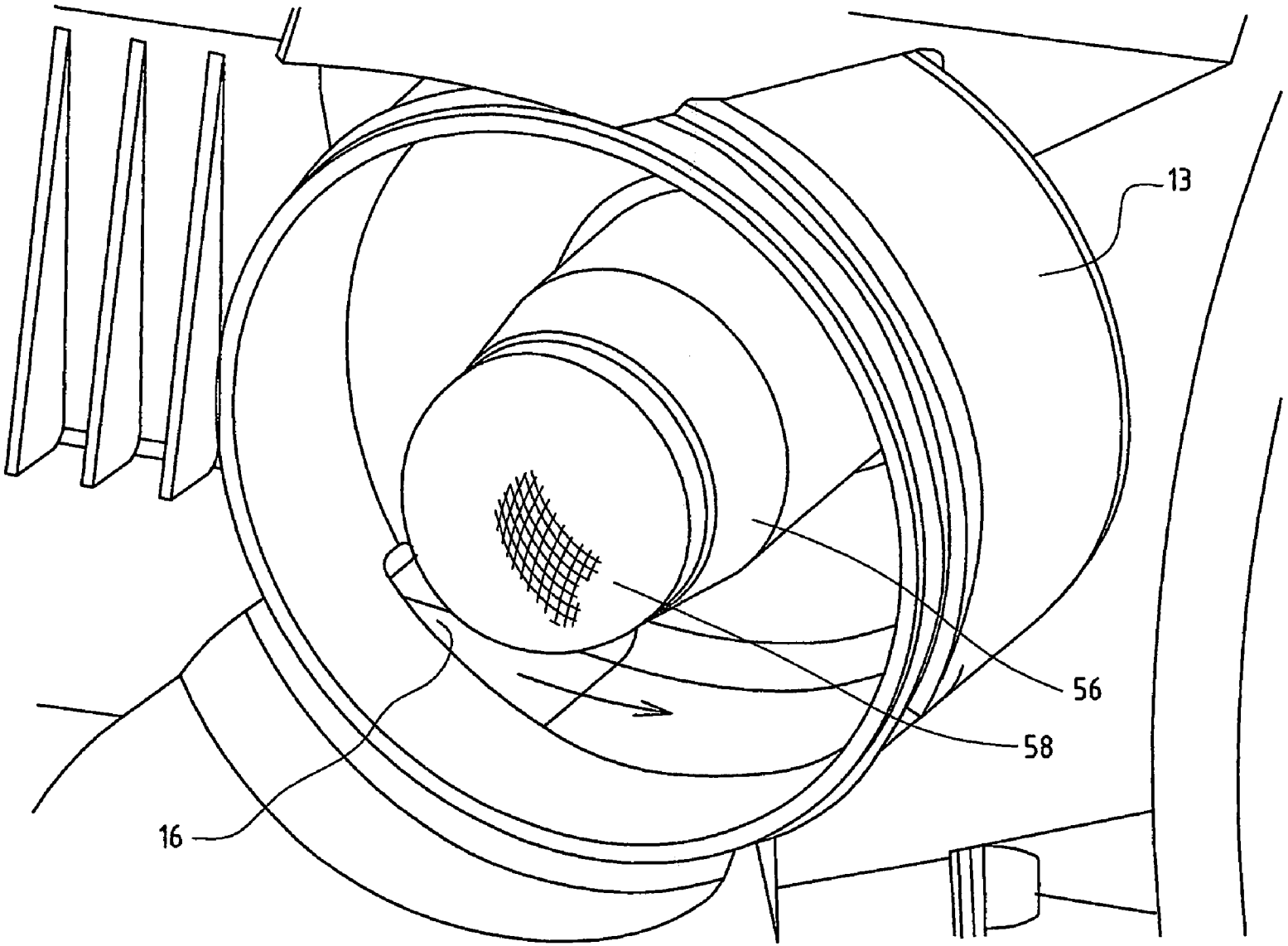
FIG. 6 is a perspective view of the interior of one part of the separating device.

Referring now to FIGS. 4, 5 and 6, these show the separator 10 in greater detail. FIGS. 5 and 6 show the interior of the body part 13 with the tangentially extending inlet 16 for dust-laden air, and, in the centre of the body part, the outlet duct 18 of which a portion 56 extends into the body part along the central axis of the separator. The part 56 is provided at its free end within the separator with a domed wire gauze element 58 which acts as an extremely coarse filter to ensure that large pieces of debris remain within the separator 10 and do not pass to the second separator 11 by way of the connecting elbow 27*a* and duct 27. Also clearly shown in FIGS. 4 and 5 is the body part 14 of the separator 10 with its tangential outlet opening 20.

The body part 13 has at its free end an annular spigot 60 which fits closely within a complementary sleeve 62 at the facing end of the body part 14. A flexible seal 64 in the form of an O-ring is accommodated in an annular recess at the base of the sleeve 62, to provide an airtight seal between the body parts 13, 14. The body part 14 is provided with two hook-like latching formations 66 which are diametrically opposite one another relative to the body part, and these are engageable with lugs 68 similarly disposed on the body part 13. Thus a "bayonet connection" is afforded between the two body parts: the body part 14 is removable from the body part 13 by firstly an angular movement of the former to disengage the formations 66, 68 followed by axial movement of the body part 14 until it is clear of the body part 13. This facilitates access to the interior of the separator for cleaning or removal of any large items of debris which, having been picked up by the vacuum cleaner, are trapped in the separator 10 being unable to leave it by way of the dust outlet 20 or the airstream outlet 18. Refitting of the body part 14 to the part 13 is of course the reverse of the removal procedure.

Figure 7:
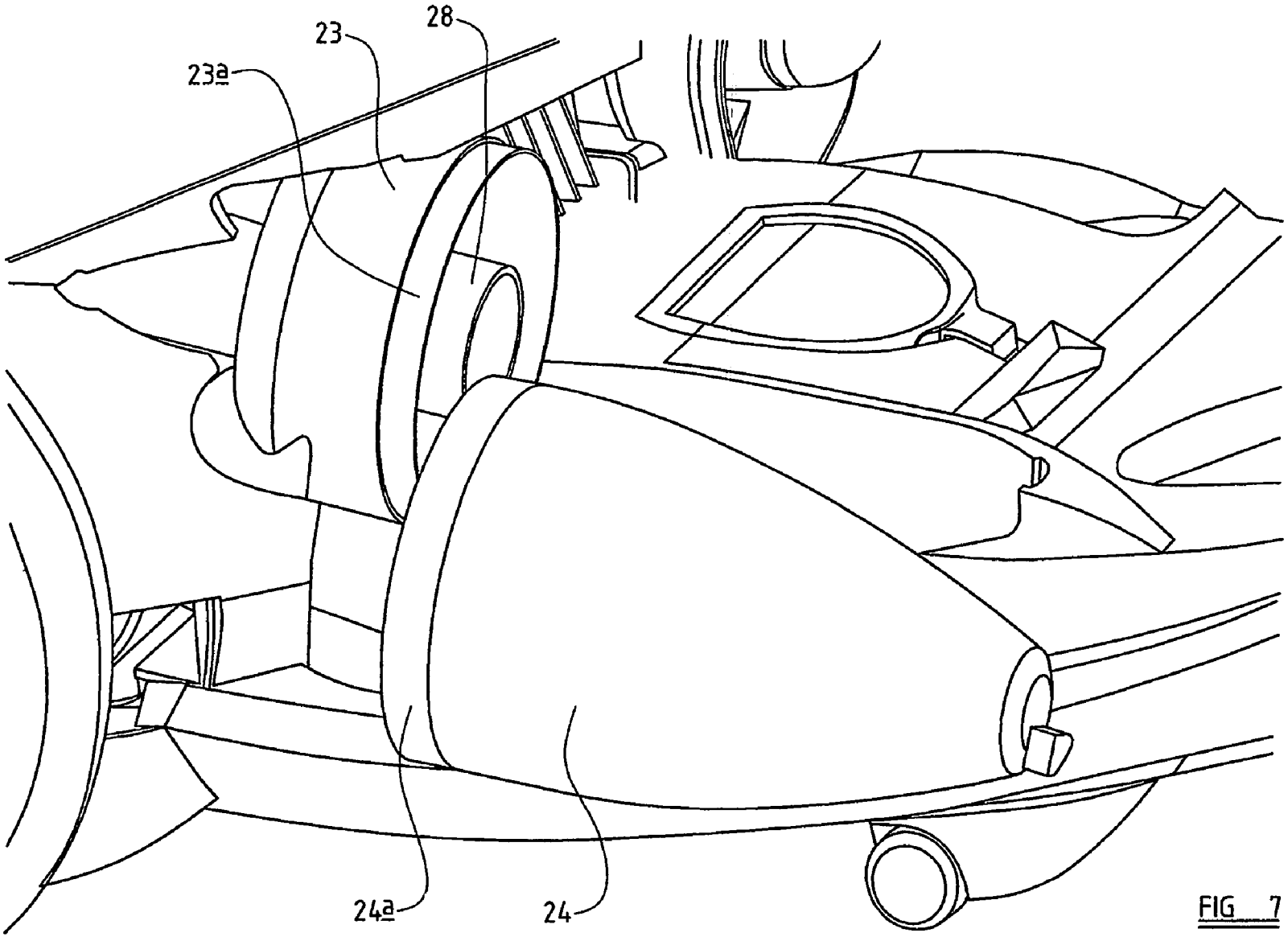
FIG. 7 is a perspective view showing removal of a part of the other separating device.

FIG. 7 shows the second separator 11 with its body part 24 removed from its body part 23. This enables the air outlet duct 28 in the interior of the body part 23 to be seen: it extends within the body of the separator to approximately the end of the body part 23. The body parts 23, 24 may fit together by a bayonet connection as described above in relation to the body parts 13, 14 of the first separator, or there may simply be frictional engagement between a spigot 23*a* at the free end of the body part 23 and a sleeve portion 24*a* at the facing end of the body part 24. A suitable seal is provided between the body parts 23, 24. It is envisaged that removal of the body part 24 of the second separator 11 is less likely to be required than is removal of the body part 14 of the first separator 10, since no large items of debris sufficient to interfere with the operation of the separator 11 should be able to reach the latter from the first separator. However, cleaning of the interior of the separator 11 may be required if damp plaster dust for example has been picked up by the suction cleaner.

Figure 8:
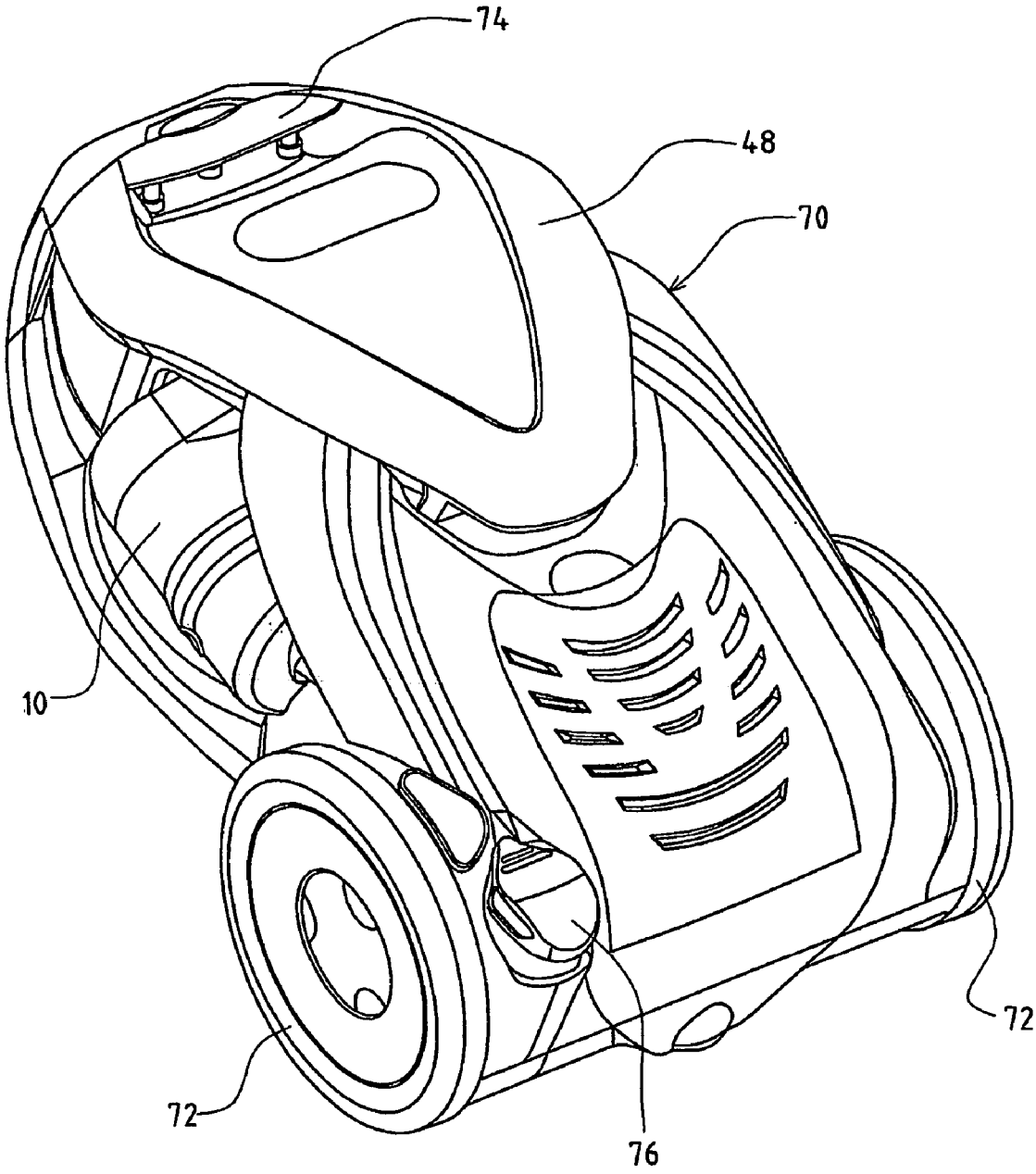
FIG. 8 is a perspective view of a suction cleaner and the separating apparatus therein.

Finally, FIG. 8 of the drawings shows diagrammatically a suction cleaner having the above described separator and dust receptacle arrangement incorporated therein. It is a cleaner of the "cylinder" type, in which a flexible hose and optionally a rigid wand are used to connect a cleaning head to the cleaner, the cleaning head being able to be moved over a surface being cleaned to pick up dust. The cleaner comprises a body with an external casing 70, having at one end a pair of wheels 72 on which, together with a further wheel or castor (not shown) underneath the casing 70 towards the opposite end thereof from the wheels 72, it can be moved over a floor surface. The cover 48 of the dust receptacle is shown and it will be noted that the configuration thereof forms part of the styling of the cleaner. Also shown in FIG. 8 is a handle 74 by which the dust receptacle may be carried when it has been removed from the cleaner for disposal of dust collected therein. Separator 10 is visible in FIG. 8, and it will be appreciated that the separator 11 is correspondingly positioned at the opposite side of the dust receptacle. An electric motor, fan for causing the required airstream in the cleaner, and such further filters as may be required are provided in the part of the casing generally between the wheels 72. Also there is a cable storage reel from which an electrical power cable having a plug 76 at its free end may be deployed for connection to a mains socket outlet, and to which the cable may be retracted after use.

Although in the above described embodiment the separators 10, 11 have their axes oriented generally parallel to one another, they may alternatively be in some other orientation. For example their axes may be generally perpendicular to one another and in this case the airstream outlet of the first separator may lead directly tangentially into the inlet of the second separator, tangentially thereof. A dust receptacle, with respective inlets oriented to register with the outlets of the separators, may then lie generally in a space partly bounded by the two separators.

Although the suction cleaner described above is of the cylinder type, it is to be understood that the present invention is not limited to use in such a cleaner: it is also applicable to cleaners of the "upright" type.

In the present specification "comprises" means "includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A dust separating apparatus for a suction cleaner, comprising a cyclonic separating device having a body with an inlet and an outlet for a stream of air, and an outlet for dust separated from the air stream to enter a receptacle for the separated dust, wherein said body comprises a part movable in relation to the rest of the body while the rest of the body remains in position in the cleaner, to provide access to the interior thereof;

wherein the cyclonic separating device comprises first and second cyclonic separating devices each comprising a body with an inlet and an outlet for the stream of air and an outlet for separated dust, the air outlet of the first separating device being connected to the air inlet of the second separating device; and the first and second devices lie within a casing of the cleaner spaced from one another with the receptacle for separated dust removeably disposed with at least part thereof generally between them, the receptacle having respective inlets for dust communicating with the dust outlets of the first and second separating devices.

2. Apparatus according to claim 1 wherein the moveable part of the body is completely removable therefrom.

3. Apparatus according to claim 2 wherein the separating device comprises the inlet and outlet for the stream of air at one end of the body and the outlet for dust at the other end of the body, the removable part having the outlet for dust therein.

4. Apparatus according to claim 3 wherein said separating device comprises a tangential air inlet and a central air outlet at the one end of the body, and the dust outlet extending tangentially at the other end of the body.

5. Apparatus according to claim 2 wherein the removable body part of the separating device engages with the rest of the body thereof by a bayonet fitting.

6. Apparatus according to claim 1 wherein at least the first separating device has a moveable body part.

7. Apparatus according to claim 1 wherein sealing means is provided between the body parts of each of the first and second separating devices, for preventing air leakage at the connection therebetween.

8. Apparatus according to claim 1 wherein said removable body parts of each of the first and second separating devices are accessible for removal after removal of said receptacle from the cleaner.

* * * * *

UNITED STATES PATENT AND TRADEMARK OFFICE

CERTIFICATE OF CORRECTION

PATENT NO. : 7,479,172 B2
APPLICATION NO. : 10/537537
DATED : January 20, 2009
INVENTOR(S) : Bengt Ivar Anders Ivarsson It is certified that error appears in the above-identified patent and that said Letters Patent is hereby corrected as shown below:

On the title page, under the subheading numeral "(86)" replace the §371 (c)(1), (2), (4) date [[Nov. 4, 2005]] with Nov. 14, 2005.

Signed and Sealed this

Twenty-third Day of June, 2009

John Doll

JOHN DOLL
*Acting Director of the United States Patent and Trademark Office*